United States Patent [19]

Anderson

[11] Patent Number: 4,949,502

[45] Date of Patent: Aug. 21, 1990

[54] CHRISTMAS TREE HOLDER

[76] Inventor: William E. Anderson, 4210 174th SE., Bothell, Wash. 98012

[21] Appl. No.: 379,812

[22] Filed: Jul. 14, 1989

Related U.S. Application Data

[63] Continuation-in-part of Ser. No. 216,958, Jul. 11, 1988, Pat. No. 4,894,949, which is a continuation-in-part of Ser. No. 470,389, Feb. 28, 1983, Pat. No. 4,796,382.

[51] Int. Cl.[5] ..... A47G 7/02

[52] U.S. Cl. ..... 47/40.5; 248/526

[58] Field of Search ..... 47/39, 40.5; 248/526, 248/524, 525

[56] References Cited

U.S. PATENT DOCUMENTS

| | | | |
|---|---|---|---|
| 328,007 | 10/1885 | Coffin | 248/524 |
| 1,028,787 | 6/1912 | Rossmeissh | 248/525 |
| 1,524,061 | 1/1925 | Tennant | 47/40.5 |
| 1,811,918 | 6/1931 | Danner | 47/40.5 |
| 1,848,556 | 3/1932 | Berman | 47/40.5 |
| 1,876,276 | 9/1932 | Danner | 47/40.5 |
| 1,898,300 | 2/1933 | Gustafson | 47/40.5 |
| 2,028,129 | 1/1936 | Allerton | 47/40.5 |
| 2,277,803 | 3/1942 | Varner | 248/524 |
| 2,416,435 | 2/1947 | Carlberg | 248/526 |
| 2,650,783 | 9/1953 | Stanley | 248/525 |
| 2,761,641 | 9/1956 | Labbers | 47/40.5 |
| 4,130,965 | 12/1978 | Patton et al. | 47/40.5 |
| 4,796,382 | 1/1989 | Anderson | 47/40.5 |

FOREIGN PATENT DOCUMENTS

| | | | |
|---|---|---|---|
| 932432 | 7/1963 | United Kingdom | 47/40.5 |

*Primary Examiner*—Danton D. DeMille
*Attorney, Agent, or Firm*—Mark Zovko

[57] ABSTRACT

A holder for Christmas trees which includes a container supported above ground level, legs to support the weight of the tree attached to the container, and holding members extending from the legs. The container is provided with sharpened points or a spike upon which the tree base rests, and can hold a reservoir of water. The legs are mounted to the container so that as the weight of the tree depresses the container, the legs spread on the floor and the holding members are forced to engage the tree trunk and hold it in place. Springs are provided at the point at which the legs are attached to the container so that the container may set above ground level at rest position with the holding members spread wide enough to accommodate various tree trunk sizes. Alternatively, a resilient stabilizing member integral with the legs and extending over the rim and into the container is provided which acts similarly to the springs of the first embodiment to hold the legs open prior to tree insertion.

2 Claims, 4 Drawing Sheets

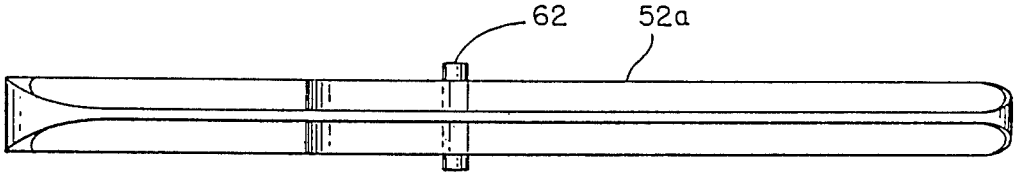
FIG. 5
FIG. 6
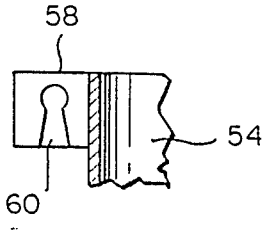
FIG. 7
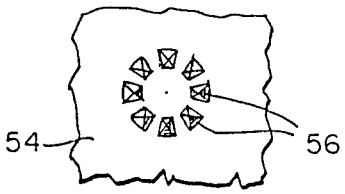
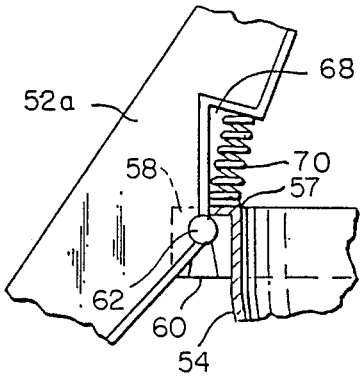
FIG. 8

CHRISTMAS TREE HOLDER

CROSS RELATION TO OTHER APPLICATION

This application is a continuation-in-part of my copending application Ser. No. 7/216,958 filed 7/11/88 which is a continuation in part of Ser. No. 6/470,389, filed 2/28/83, which is now issued as U.S. Pat. No. 4,796,382.

BACKGROUND OF THE INVENTION

1. Field of the Invention

This invention relates to stands for supporting a tree, and more specifically to a Christmas tree holder which can accommodate a wide range of Christmas tree sizes.

2. Description of the Prior Art

Various types of Christmas tree stands or holders have been provided in the prior art. A typical stand which one may see includes screws to hold the base of the tree in place and an annular ring which supports these screws. Several disadvantages of this design are apparent. For example, the mounting and dismounting operations of these prior art stands are relatively time consuming and difficult. Many times two persons are needed to mount the tree suitable, and even then, stability and alignment problems can occur, especially with heavier trees. Occasionally the fastening means may work loose from the tree trunk. Also, the prior art designs which obviate the above problems are relatively complicated and expensive to produce. The present invention, therefore, recognizes the need for a new improved tree holder which elimiantes the above shortcomings.

SUMMARY OF THE INVENTION

The Christmas tree holder of the present invention consists of a container for holding the tree and a reservoir of water. The container is mounted to three or more legs which support the weight of the Christmas tree in operational position. In rest position, the container is held slightly above the floor level. The legs of the stand are attached to the container, in one embodiment, by pins and brackets located an equal distance apart on the outer rim of the container or by pins through slots located in the outer lip of the container. The legs are triangular in an elevation view in the preferred embodiment of the invention.

Extending from the upper part of each leg is a holding member. The holding members are such that at rest a Christmas tree trunk may fit through them. To place the stand in service, the tree trunk is placed within the holding members and allowed to contact the bottom of the container. The container bottom can have impaling means such as a spike or sharpened points which will engage the base of the tree trunk. The weight of the tree will push the container to floor level and cause the legs of the holder to spread thereby forcing the holding members to grip the tree trunk tightly and hold the tree in a stable position with the container resting on the floor.

To fix the holding members in place at a suitable distance prior to insertion of the tree in the holder, springs contacting the legs can be used. Alternatively, a resilient stabilizing member integral with the legs and made from a plastic material can be used. This resilient stabilizing member is adjacent to pins which fit in slots in an outer lip portion of the rim.

Accordingly, it is the object of the present invention to provide a new and improved tree holder which is relatively simple and inexpensive in design and construction and incorporates few moving parts.

Another object of the present invention is to provide a tree holder which enables rapid mounting and dismounting of the tree onto the stand without the need for special screws or nails.

A further object of the present invention is to provide a tree holder which may accommodate a variety of tree trunk sizes without making modifications to parts of the holder.

Still another object of the present invention is to provide a stable Christmas tree holder which can accommodate a variety of tree sizes.

These and other objects and advantages of the present invention will become apparent from the following detailed description when taken in conjunction with the drawings provided.

BRIEF DESCRIPTION OF THE DRAWINGS

FIG. 5 is a front view of a leg shown in FIGS. 3 and 4 in accordance with the alternative embodiment of the invention.

FIG. 6 is a cross sectional view through the container of FIGS. 3 and 4 showing a slot in the outer lip of the container.

FIG. 7 is a partial plan view of the container of FIGS. 3 and 4 showing the sharpened points for impaling the tree.

FIG. 8 is a partial elevational view showing the leg and retaining spring of an alternative embodiment of the invention.

DESCRIPTION OF THE PREFERRED EMBODIMENT

Figure 1:
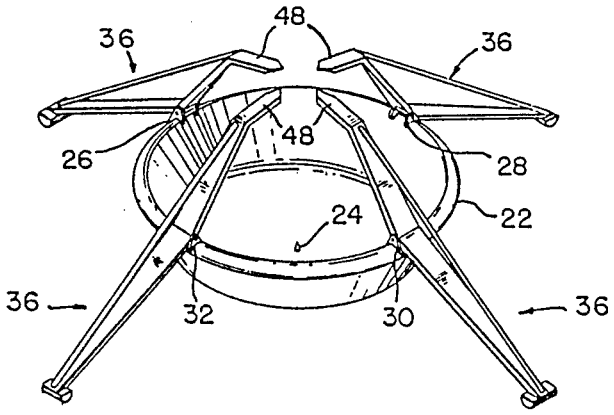
FIG. 1 is a perspective view of a tree stand incorporating the invention.
Figure 2:
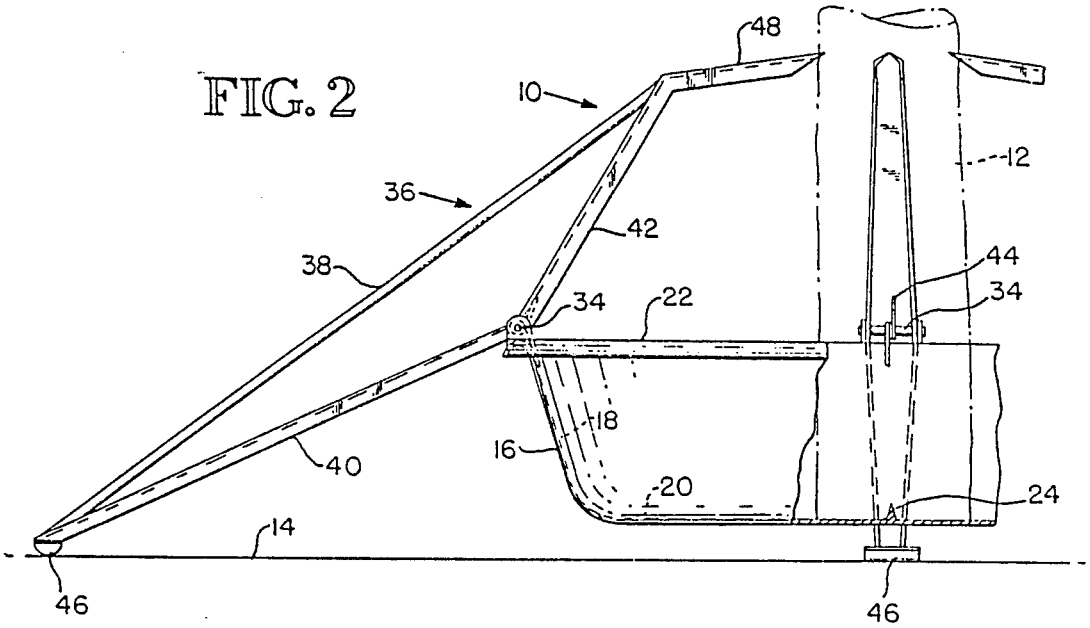
FIG. 2 is a partial elevational view of a tree stand incorporating the present invention.

Referring to FIGS. 1 and 2, a tree stand generally designated as 10 is shown for supporting a tree 12, such as a Christmas tree or the like in an upright position upon a floor surface 14. The tree stand includes a container generally designed as 16. Container 16 is generally bowl shaped having a wall 18 and base 20. The container 16 also has an outer rim 22 which is shown best in FIG. 1. The container 16 is upwardly open to allow a reservoir of water (not shown) to be contained therein. Impaling means is provided in container 16 on base 20 for impaling the bottom of the trunk of tree 12. The impaling means consists of a centering pin or sharpened point 24 embedded in base 20 of the container 16 at a centrally located position and extending upward along the longitudinal axis of the trunk of tree 12.

Around the outer rim 22 of container 16 are located brackets 26, 28, 30 and 32. The brackets are fixedly attached to the outer rim 22, preferably forming an integral part with the rim. Each bracket has a hole therethrough adapted to receive a pin 34 or other fastening means. The midpoints of the brackets are spaced equidistant around the circumference of the outer rim. Each bracket is adapted to hold a support leg, generally designated as 36, having three support members. The three support members consist of a long member 38, a middle-size member 40 and a short member 42. The support members form a triangular shape as shown in the elevation view of FIG. 2 with the apex of members 40 and 42 being attached to a bracket pair. The attachment is accomplished for each leg 36 by pin 34 fitting through holes in the members which correspond to the holes in the brackets. At this point of attachment, spring means 44 is located. Spring means 44 is wound around each pin 34 and rests against support member 42 and the wall 18 of the container 16, thereby preventing the leg 36 from spreading due to the weight of container 16 in the rest position prior to insertion of tree 12. The apex of support members 38 and 40 has a support pad 46 fixedly attached thereto, which rests on the floor 14. Support pad 46 is preferably of a semi-circular shape in cross section as shown in FIG. 2. At the apex of support member 38 and support member 42 is fixedly attached a holding member 48. The holding member 48 forms a slight angle with the horizontal and is inwardly directed toward the center of the assembly. Prior to insertion of tree 12, the holding members of the legs of the assembly are spaced wide enough apart so as to permit the trunk of a tree to be inserted therein. The leading edge of holding member 48 is preferably pointed or alternatively may be serrated or otherwise shaped to provide a firmer grip upon the trunk of tree 12 when it is inserted in the assembly.

It should be noted that although the drawings show the Christmas tree holder to have four brackets and four legs, the tree holder may also have three brackets and three legs spaced equidistant around the outer rim of the container and still be workable. Also, although it is not shown in the drawings, support member 38 of leg 36 may be bolted to support members 40 and 42. Allowing support member 38 to be detachable from support members 40 and 42 may be desirable from a manufacturing standpoint.

In operation, a sawed-off tree trunk is first prepared for mounting by driving a sharp object such as a nail into the center of the trunk base, and then removing the nail to provide an opening for receiving sharpened point 24. The stand 10 is then placed in a upright position with the legs 36 resting on the floor 14 and the container 16 supported above the floor. The tree is then lowered into stand 10 through the opening between holding members 48 with the tree being guided to center upon the sharpened point 24. Alternatively, the tree may be lowered through holding members 48 until the trunk touches sharpened point 24. A blow of a hammer or other tool on the base 20 would then directly impale the tree trunk. The full weight of the tree 12 is now allowed to react on the base 20 of the container. This reaction will cause the container 16 to lower to rest on the floor, thereby spreading legs 36 and causing holding members 48 to secure engagement with the trunk of the tree 12. The tree is held fast in a stable upright position. For dismounting the tree, the tree may be raised to relieve the weight on container 16, thereby causing holding members to cease holding the trunk. The tree may then be pulled from the sharpened point 24.

From the above description, it can be seen that the present invention provides a new and improved tree holder having advantages over existing designs. The stand is comprised of a relatively few inexpensive elements, and may readily mount a Christmas tree without the need for nails or screws as other designs require. The tree stand provides a stable support for the tree and one size of stand may accommodate a wide range of tree sizes.

Figure 3:
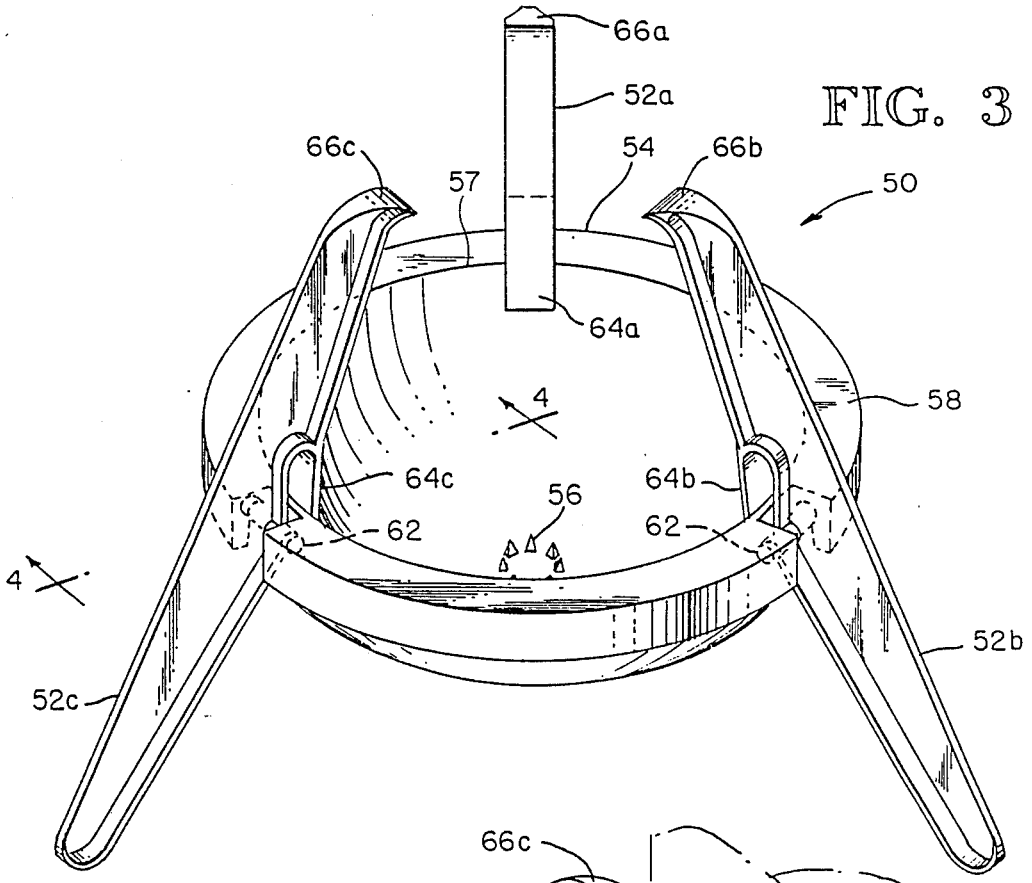
FIG. 3 is a perspective view of a tree stand incorporating an alternative embodiment of the invention.
Figure 4:
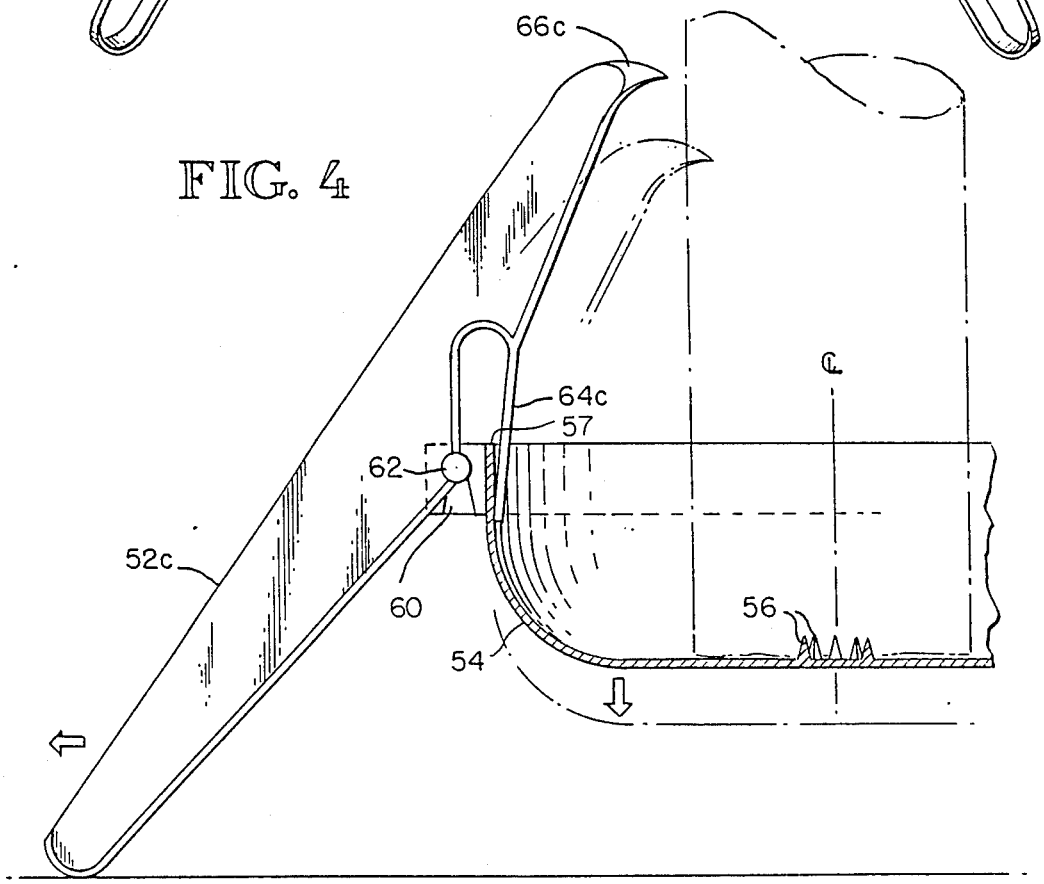
FIG. 4 is a partial elevational view partially in cross section of a tree stand incorporating an alternative embodiment of the invention.

FIGS. 3 and 4 show an alternative embodiment of the present invention. This embodiment is similar in function to the above described embodiment, differing only in its construction to accomplish the same task of supporting a tree. Referring to FIGS. 3 and 4, a tree holder generally designated as 50 is shown, having three support legs **52*a*, 52*b*, 52*c*, generally triangular in shape. The legs 52*a*, 52*b* and 52*c* support a container 54. The container 54 has impaler 56 which are several pointed pieces of metal on the bottom thereof, and has a rim 57 with an outer lip portion 58. The outer lip portion 58 is projected outward and vertically downward relative to the container 54. The outer lip portion 58 has three sets or pairs of slots generally designated as 60. The slots are flared outward and somewhat similar in shape to a conventional keyhole and ideally spaced equidistant on the circumference of the rim 57. Legs 52*a*, 52*b* and 52*c* have pins generally designated as 62 which are adapted to fit in the slots 60. Legs 52*a*, 52*b* and 52*c* also have resilient stabilizing members 64*a*, 64*b* and 64*c* integral with the legs and which are adjacent to the pins, fit over the outer lip portion 58, and contact the inside of container 54 as best shown in FIG. 4. The legs 52*a*, 52*b* and 52*c* have top portions 66*a*, 66*b* and 66*c* for contacting a trunk of a tree placed therein. The bottom of the legs, of course, contact the floor. The legs 52*a*, 52*b* and 52*c* are rotably mounted to the container 54 about pins 62 in a similar manner as the previously described embodiment. In this embodiment, however, the resilient stabilizing members 64*a*, 64*b* and 64*c* perform the function of the springs 44 of FIG. 2 by allowing the top portions 66*a*, 66*b* and 66*c* of the legs to be retained in an "open" position prior to inserting a tree in the holder 50, and also support container 54 above ground level prior to tree insertion. When a tree is placed between the top portions 66*a*, 66*b* and 66*c* of the legs, the holder 50 operates as does the holder described previously in FIGS. 1 and 2. The weight of the tree trunk depresses container 54 until the impalers 56 impale the bottom of the tree trunk. Resilient stabilizing members 64*a*, 64*b* and 64*c* have enough resiliency to deform but not break as the tree trunk forces the container 54 to floor level. Of course, the bottom of the legs are spread wider on the floor relative to their position prior to tree insertion. It should be noted that the resilient stabilizing members 64*a*, 64*b* and 64*c*** can be made of any one of a number of suitable resilient plastics well known in the conventional art.

FIG. 8 shows an alternative to the resilient members **64*a*, 64*b* and 64*c* for maintaining the legs 52*a*, 52*b* and 52*c* open and the container 54 above ground level prior to insertion of a tree therein. This embodiment is identical to that of FIG. 3 and 4 except that each leg 52*a*, 52*b* and 52*c* has a recessed portion 68. A coil spring 70 is provided which is suitable fastened to the recessed portion 68 of legs 52*a*, 52*b* and 52*c*. The bottom of spring contacts the outer lip portion 58 of container 54 and serves to maintain the legs 52*a*, 52*b* and 52*c* in an open position prior to insertion of the tree therein. Of course, the spring is in compression prior to tree insertion. As the tree is inserted through the legs and contacts the bottom of container, the force of the spring is overcome and the top portion 66a, 66b and 66c** contact and hold the tree.

Figure 9:
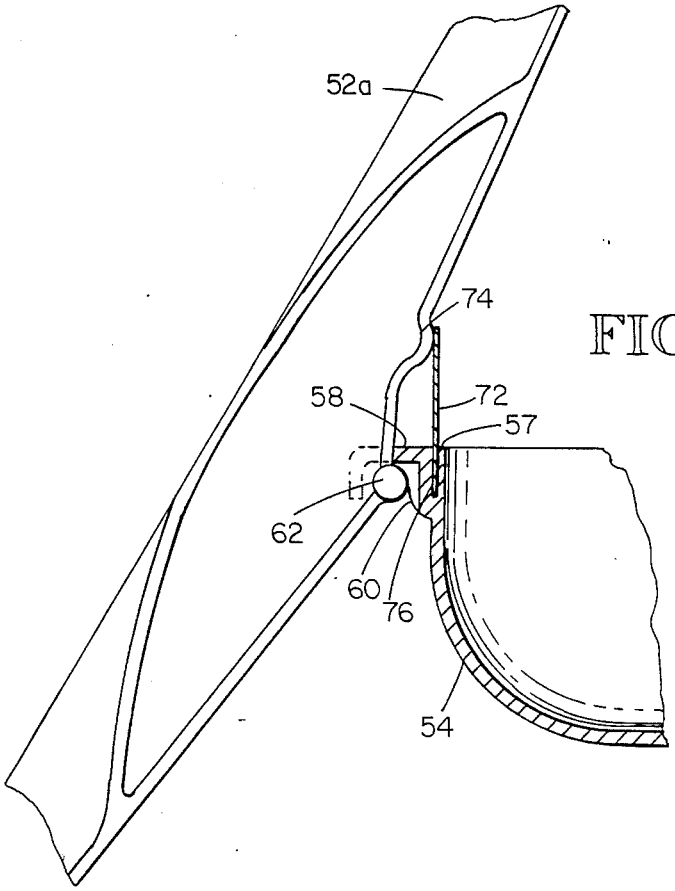
FIG. 9 is a partial elevational view showing the leg and retaining leaf spring of another alternative embodiment of the invention.
Figure 10:
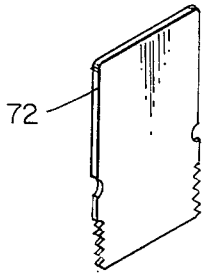
FIG. 10 is a pictoral view of a leaf spring used in FIG. 9.

FIG. 9 shows yet a further embodiment of the present invention using a different type of spring than that shown in FIG. 8. FIG. 9 shows a leaf spring 72 generally rectangular in shape which holds the legs 52a, 52b, and 52c open and the container 54 above the ground prior to insertion of the tree therein. The upper part of leaf spring 72 rests against a protruding portion 74 located on each leg 52a, 52b and 52c. The lower part of leaf spring 72 is disposed and held in an opening 76 in rim 57. Leaf spring 72 placed in the above described manner on each leg thereby resists the tendency of the legs to slide outwardly on the floor from the weight of the container 54. The container 54 therefore is held above ground level and top portions 66a, 66b and 66c of the legs are kept at a distance great enough to allow insertion of the tree therethrough. When the tree is placed in the container 54 and contacts the impaling means 56, the resisting force of leaf spring 72 is overcome by the weight of the tree and the top portion 66a, 66b and 66c of legs 52a, 52b and 52c contact and hold the tree.

The invention may be embodied in other forms without departing from the spirit or essential characteristics thereof. The present embodiments are therefore to be considered in all respects as illustrative and not restrictive, scope of the invention being indicated by the appended claims rather than by the foregoing description, and all changes which come within the meaning and range of equivalency of the claims for therefore intended to be embraced therein.

What I claim is:

1. A tree holder comprising a. a container having a bottom and a rim, said rim having at least three openings therein, said rim also having an outer lip, said outer lip having a portion extending outwardly and a portion extending downwardly, said outer lip having at least three sets of slots therein;

b. at least three legs, each leg having a top portion for contacting and supporting a tree, each leg having a bottom portion contacting the ground, each leg having pin means adapted to be received by one of said three sets of slots in said outer lip so as to allow rotation of said legs about a longitudinal axis running through said pin means whereby the weight of a tree placed within the top portions of said legs into said container and contacting the bottom of said container depresses said container to the ground and causes the top portions of said legs to contact and support the tree, and each leg having a protruding portion thereon;

c. at least three leaf springs, each leaf spring having a top and a bottom, the bottom of said leaf springs being disposed in each of said openings in said rim, and the top of said leaf springs contacting the protruding portion of each leg for maintaining said container in a position above ground level prior to insertion of a tree therein.

2. The tree holder of claim 1 which includes impaling means disposed in the bottom of said container for engaging a tree placed in said container.

* * * * *